US011085108B2

(12) United States Patent
Damm et al.

(10) Patent No.: US 11,085,108 B2
(45) Date of Patent: Aug. 10, 2021

(54) STEEL FOR A TOOL HOLDER

(71) Applicant: Uddeholms AB, Hagfors (SE)

(72) Inventors: Petter Damm, Karlstad (SE); Lena Rahlen, Uddeholm (SE); Amanda Forsberg, Filipstad (SE); Victoria Bergqvist, Uddeholm (SE); Riccardo Zanchetta, Milan (IT)

(73) Assignee: Uddeholms AB, Hagfors (SE)

( * ) Notice: Subject to any disclaimer, the term of this patent is extended or adjusted under 35 U.S.C. 154(b) by 261 days.

(21) Appl. No.: 16/314,240

(22) PCT Filed: Jun. 7, 2017

(86) PCT No.: PCT/SE2017/050603
§ 371 (c)(1),
(2) Date: Dec. 28, 2018

(87) PCT Pub. No.: WO2018/004419
PCT Pub. Date: Jan. 4, 2018

(65) Prior Publication Data

US 2019/0226059 A1 Jul. 25, 2019

(30) Foreign Application Priority Data

Jun. 30, 2016 (SE) ..... 1650948-1

(51) Int. Cl.

| | |
|---|---|
| ***C22C 38/02*** | (2006.01) |
| ***C22C 38/58*** | (2006.01) |
| ***C22C 38/44*** | (2006.01) |
| ***C22C 38/04*** | (2006.01) |
| ***C22C 38/06*** | (2006.01) |
| ***C22C 38/46*** | (2006.01) |
| ***C21D 6/02*** | (2006.01) |
| ***C21D 6/00*** | (2006.01) |

(52) U.S. Cl.
CPC ..... *C22C 38/02* (2013.01); *C21D 6/004* (2013.01); *C21D 6/02* (2013.01); *C22C 38/04* (2013.01); *C22C 38/06* (2013.01); *C22C 38/44* (2013.01); *C22C 38/46* (2013.01); *C22C 38/58* (2013.01); *C21D 2211/001* (2013.01); *C21D 2211/002* (2013.01); *C21D 2211/008* (2013.01)

(58) Field of Classification Search
CPC ..... C21D 2211/001; C21D 2211/002; C21D 2211/008; C21D 6/004; C21D 6/02; C22C 38/02; C22C 38/04; C22C 38/06; C22C 38/44; C22C 38/46; C22C 38/58
See application file for complete search history.

(56) References Cited

U.S. PATENT DOCUMENTS

| | | | | |
|---|---|---|---|---|
| 5,139,737 | A | 8/1992 | Sudo et al. | |
| 2006/0144483 | A1* | 7/2006 | Beguinot | C21D 1/19 148/661 |
| 2011/0108169 | A1 | 5/2011 | Beguinot et al. | |
| 2013/0037182 | A1 | 2/2013 | Sourmail | |
| 2015/0299835 | A1* | 10/2015 | Beguinot | C21D 9/46 148/621 |

FOREIGN PATENT DOCUMENTS

| | | | |
|---|---|---|---|
| AU | 199869810 | | 12/1998 |
| CN | 102016097 | A | 4/2011 |
| CN | 102985569 | A | 3/2013 |
| EP | 0882808 | A1 | 12/1998 |
| EP | 1087030 | A3 | 5/2003 |
| JP | H04297548 | A | 10/1992 |
| JP | H07173541 | A | 7/1995 |
| JP | H0813088 | A | 1/1996 |
| JP | 2001355039 | A | 12/2001 |
| JP | 2010229453 | A | 10/2010 |
| JP | 2011084809 | A | 4/2011 |
| JP | 2016056450 | A | 4/2016 |
| KR | 20150066623 | A | 6/2015 |
| RU | 2258762 | C2 | 8/2005 |
| RU | 2005120086 | A | 1/2007 |
| RU | 2309190 | C2 | 10/2007 |
| RU | 2314361 | C2 | 1/2008 |
| WO | WO-2003/083154 | A1 | 10/2003 |
| WO | 2014141697 | A1 | 9/2014 |

OTHER PUBLICATIONS

Chinese Office Action dated Jun. 16, 2020, for Chinese Patent Application No. 201780040527.9.
European Search Report for European Patent Application No. 17820638.9, dated Jun. 26, 2019.
Russian Office Action dated Jul. 8, 2020, for Russian Patent Application No. 2019102410/05(004286).
Russian Search Report dated Jul. 8, 2020, for Russian Patent Application No. 2019102410/05(004286).
Chinese Office Action dated Dec. 2, 2020, for Chinese Patent Application No. 201780040527.9.
International Search Report for Application No. PCT/SE2017/050603, dated Sep. 5, 2017.
Japanese Office Action dated Mar. 29, 2021, for Japanese Patent Application No. 2018-563659.
Chinese Office Action dated Apr. 13, 2021, for Chinese Patent Application No. 201780040527.9.

* cited by examiner

*Primary Examiner* — Jenny R Wu
(74) *Attorney, Agent, or Firm* — Karceski IP Law, PLLC

(57) ABSTRACT

The invention relates to a steel for a tool holder. The steel comprises the following main components (in wt. %):

C 0.07-0.13
Si 0.10-0.45
Mn 1.5-3.1
Cr 2.4-3.6
Ni 0.5-2.0
Mo 0.1-0.7
Al 0.001-0.06
S≤0.003

The steel has a bainitic microstructure comprising up to 20 volume % retained austenite and up to 20 volume % martensite.

10 Claims, No Drawings

STEEL FOR A TOOL HOLDER

TECHNICAL FIELD

The invention relates to a steel for a tool holder. In particular, the invention relates to a steel suitable for the manufacturing of large tool holders for indexable insert cutting tools.

BACKGROUND OF THE INVENTION

The term tool holder means the body on which the active tool portion is mounted at the cutting operation. Typical cutting tool bodies are milling and drill bodies, which are provided with active cutting elements of high speed steel, cemented carbide, cubic boron nitride (CBN) or ceramic. The material in such cutting tool bodies is usually steel, within the art of designated holder steel.

The cutting operation takes place at high cutting speeds, which implies that the cutting tool body may become very hot, and therefore it is important that the material has a good hot hardness and resistance to softening at elevated temperatures. To withstand the high pulsating loads, which certain types of cutting tool bodies, such as milling bodies are subjected to, the material must have good mechanical properties, including a good toughness and fatigue strength. To improve the fatigue strength, compressive stresses are commonly introduced in the surface of the cutting tool body. The material should therefore have a good ability to maintain said applied compressive stresses at high temperatures, i.e. a good resistance against relaxation. Cutting tool bodies are tough hardened, while the surfaces against which the clamping elements are applied can be induction hardened. Therefore the material shall be possible to harden by induction hardening. Certain types of the cutting tool bodies, such as certain drill bodies with soldered cemented carbide tips, are coated with PVD or subjected to nitriding after hardening in order to increase the resistance against chip wear in the chip flute and on the drill body. The material shall therefore be possible to coat with PVD or to subject to nitriding on the surface without any significant reduction of the hardness. Traditionally, low and medium alloyed engineering steels like 1.2721, 1.2738 and SS2541 have been used as material for cutting tool bodies.

It is also known to use hot work tool steel as a material for cutting tool holders. WO 97/49838 and WO 2009/116933 disclose the use of a hot work tool steels for cutting tool holders. Presently, two popular hot work tool steels used for cutting tool bodies are provided by Uddeholms AB and sold under the names UDDEHOLM BURE® and UDDEHOLM BALDER®. The nominal compositions of said steels are given in Table 1 (wt. %).

TABLE 1

| Steel | C | Si | Mn | Cr | Ni | Mo | V |
|---|---|---|---|---|---|---|---|
| UDDEHOLM BURE ® | 0.39 | 1.0 | 0.4 | 5.3 | — | 1.3 | 0.9 |
| UDDEHOLM BALDER ® | 0.30 | 0.3 | 1.2 | 2.3 | 4.00 | 0.8 | 0.8 |

These types of hot work tool steels possess very good properties for the intended use as cutting tool holders. In particular, these steels have a combination of high hot strength and good machinability.

Disclosure of the Invention

The object of the present invention is to provide a steel for tool holders having an improved property profile.

A further object is to provide a steel for tool holders having uniform properties also in large dimensions and being optimized for large tool holders.

For large tool holders the impact toughness, the chemical and microstructural homogeneity and a low content of non-metallic inclusions are important parameters and the hot strength is of minor interest since large tool holders have a significant lower working temperature than smaller tool holders. In addition, good welding properties are necessary such that the steels can be welded without preheating and postheating.

The foregoing objects, as well as additional advantages are achieved to a significant measure by providing a steel having a composition and microstructure as set out in the claims. In particular, the high and uniform hardness in combination with a high toughness results in a steel with good chock resistance and a minimum risk for unexpected failure, leading to a safer tool holder and a prolonged tool life.

The invention is defined in the claims.

The steel of the invention consists of in weight % (wt. %):

| | |
|---|---|
| C | 0.07-0.13 |
| Si | 0.10-0.45 |
| Mn | 1.5-3.1 |
| Cr | 2.4-3.6 |
| Ni | 0.5-2.0 |
| Mo | 0.1-0.7 |
| Al | 0.001-0.06 |
| S | ≤0.003 |

optionally

| | |
|---|---|
| N | 0.006-0.06 |
| V | 0.01-0.2 |
| Co | ≤8 |
| W | ≤1 |
| Nb | ≤0.05 |
| Ti | ≤0.05 |
| Zr | ≤0.05 |
| Ta | ≤0.05 |
| B | ≤0.01 |
| Ca | ≤0.01 |
| Mg | ≤0.01 |
| REM | ≤0.2 |

balance Fe apart from impurities and the steel has a bainitic microstructure comprising up to 20 volume % retained austenite and up to 20 volume % martensite.

The steel may fulfil the following requirements:

| | |
|---|---|
| C | 0.08-0.12 |
| Si | 0.10-0.4 |
| Mn | 2.0-2.9 |
| Cr | 2.4-3.6 |
| Ni | 0.7-1.2 |
| Mo | 0.15-0.55 |
| Al | 0.001-0.035 |

optionally

| | |
|---|---|
| N | 0.006-0.03 |
| V | 0.01-0.08 |
| Cu | ≤1 |
| Co | ≤1 |
| W | ≤0.1 |
| Nb | ≤0.03 |

-continued

| | |
|---|---|
| Ti | ≤0.03 |
| Zr | ≤0.03 |
| Ta | ≤0.03 |
| B | ≤0.001 |
| Ca | ≤0.001 |
| Mg | ≤0.01 |
| REM | ≤0.1 |
| H | ≤0.0005 |

and retained austenite 2-20 vol. %.

The steel may also fulfil at least one of the following requirements:

| | |
|---|---|
| C | 0.08-0.11 |
| Si | 0.15-0.35 |
| Mn | 2.2-2.8 |
| Cr | 2.5-3.5 |
| Ni | 0.85-1.15 |
| Mo | 0.20-0.45 |

optionally

| | |
|---|---|
| N | 0.01-0.03 |
| V | 0.01-0.06 |
| Co | ≤0.3 |
| Nb | ≤0.01 |
| Ti | ≤0.01 |
| Zr | ≤0.01 |
| Ta | ≤0.01 |
| REM | ≤0.05 |
| H | ≤0.0003 |

and retained austenite 5-10 vol. %.

In a particular preferred embodiment the steel comprises:

| | |
|---|---|
| C | 0.08-0.11 |
| Si | 0.1-0.4 |
| Mn | 2.2-2.8 |
| Cr | 2.5-3.5 |
| Ni | 0.7-1.2 |
| Mo | 0.15-0.45 |

The microstructure may be adjusted such that the amount of retained austenite is 4-15 volume % and/or the amount of martensite is 2-16 volume %. Preferably the amount of retained austenite is 4-12 volume % and/or the amount of martensite is 4-12 volume %. More preferably the amount of retained austenite is 5-9 volume % and/or the amount of martensite is 5-10 volume %.

The hardness of may be 38-42 HRC and/or a 360-400 $HBW_{10/3000}$ and the steel may have a mean hardness in the range of 360-400 $HBW_{10/3000}$, wherein the steel has a thickness of at least 100 mm and the maximum deviation from the mean Brinell hardness value in the thickness direction measured in accordance with ASTM E10-01 is less than 10%, preferably less than 5%, and wherein the minimum distance of the centre of the indentation from the edge of the specimen or edge of another indentation shall be at least two and a half times the diameter of the indentation and the maximum distance shall be no more than 4 times the diameter of the indentation.

The steel may have a cleanliness fulfilling the following maximum requirements with respect to micro-slag according to ASTM E45-97, Method A:

| A | A | B | B | C | C | D | D |
|---|---|---|---|---|---|---|---|
| T | H | T | H | T | H | T | H |
| 1.0 | 0 | 1.5 | 1.0 | 0 | 0 | 1.5 | 1.0 |

DETAILED DESCRIPTION

The importance of the separate elements and their interaction with each other as well as the limitations of the chemical ingredients of the claimed alloy are briefly explained in the following. All percentages for the chemical composition of the steel are given in weight % (wt. %) throughout the description. The amount of hard phases is given in volume % (vol. %). Upper and lower limits of the individual elements can be freely combined within the limits set out in the claims.

Carbon (0.07-0.13%)

Carbon is effective for improving the strength and the hardness of the steel. However, if the content is too high the steel may be difficult to work after cooling from hot working and repair welding becomes more difficult. C should be present in a minimum content of 0.07%, preferably at least 0.08, 0.9, or 0.10%. The upper limit for carbon is 0.13% and may be set to 0.12, 0.11 or 0.10%. A preferred range is 0.08-0.12%, a more preferred range is 0.085-0.11%.

Silicon (0.10-0.45%)

Silicon is used for deoxidation. Si is present in the steel in a dissolved form. Si is a strong ferrite former and increases the carbon activity and therefore the risk for the formation of undesired carbides, which negatively affect the impact strength. Silicon is also prone to interfacial segregation, which may result in decreased toughness and thermal fatigue resistance. Si is therefore limited to 0.45%. The upper limit may be 0.40, 0.35, 0.34, 0.33, 0.32, 0.31, 0.30, 0.29 or 0.28%. The lower limit may be 0.12, 0.14, 0.16, 0.18 or 0.20%. Preferred ranges are 0.15-0.40% and 0.20-0.35%.

Manganese (1.5-3.1%)

Manganese contributes to improving the hardenability of the steel. If the content is too low then the hardenability may be too low. At higher sulphur contents manganese prevents red brittleness in the steel. Manganese shall therefore be present in a minimum content of 1.5%, preferably at least 1.6, 1.7, 1.8, 1.8, 1.9 2.0, 2.1, 2.2, 2.3 or 2.4%. The steel shall contain maximum 3.1%, preferably maximum 3.0, 2.9, 2.8 or 2.7%. A preferred range is 2.3-2.7%.

Chromium (2.4-3.6%)

Chromium is to be present in a content of at least 2.4% in order to provide a good hardenability in larger cross sections during the heat treatment. If the chromium content is too high, this may lead to the formation of high-temperature ferrite, which reduces the hot-workability. The lower limit may be 2.5, 2.6, 2.7, 2.8 or 2.9%. The upper limit is 3.6% and may be 3.5, 3.4, 3.3, 3.2 or 3.1%. A preferred range is 2.7-3.3%.

Nickel (0.5-2.0%)

Nickel gives the steel a good hardenability and toughness. Nickel is also beneficial for the machinability and polishability of the steel. If the nickel content exceeds 2.0% the hardenability may be unnecessary high. The upper limit may therefore be 1.9, 1.8, 1.7, 1.6, 1.5, 1.4, 1.3, 1.2 or 1.1%. The lower limit may be 0.6, 0.7, 0.8 or 0.9%. A preferred range is 0.85-1.15%.

Molybdenum (0.1-0.7%)

Mo is known to have a very favourable effect on the hardenability. Molybdenum is essential for attaining a good secondary hardening response. The minimum content is 0.1%, and may 0.15, 0.2, 0.25 or 0.3%. Molybdenum is a strong carbide forming element and also a strong ferrite former. The maximum content of molybdenum is therefore 0.7%. Preferably Mo is limited to 0.65, 0.6, 0.55, 0.50, 0.45 or 0.4%. A preferred range is 0.2-0.3%.

Aluminium (0.001-0.06%)

Aluminium may be used for deoxidation in combination with Si and Mn. The lower limit may be set to 0.001, 0.003, 0.005 or 0.007% in order to ensure a good deoxidation. The upper limit is restricted to 0.06% for avoiding precipitation of undesired phases such as AlN. The upper limit may be 0.05, 0.04, 0.035, 0.03, 0.02 or 0.015%.

Vanadium (0.01-0.2%)

Vanadium forms evenly distributed primary precipitated carbides and carbonitrides of the type V(N,C) in the matrix of the steel. This hard phase may also be denoted MX, wherein M is mainly V but Cr and Mo may be present and X is one or more of C, N and B. Vanadium may therefore optionally be present to enhance the tempering resistance. However, at high contents the machinability and toughness deteriorates. The upper limit may therefore be 0.15, 0.1, 0.08, 0.06 or 0.05%.

Nitrogen (0.006-0.06%)

Nitrogen may optionally be adjusted to 0.006-0.06% in order to obtain a desired type and amount of hard phase, in particular V(C,N). When the nitrogen content is properly balanced against the vanadium content, vanadium rich carbonitrides V(C,N) will form. These will be partly dissolved during the austenitizing step and then precipitated during the tempering step as particles of nanometer size. The thermal stability of vanadium carbonitrides is considered to be better than that of vanadium carbides, hence the tempering resistance of the tool steel may be improved and the resistance against grain growth at high austenitizing temperatures is enhanced. The lower limit may be 0.011, 0.012, 0.013, 0.014, 0.015, 0.016, 0.017, 0.018, 0.019 or 0.02%. The upper limit may be 0.06, 0.05, 0.04 or 0.03%.

Cobalt (≤8%)

Co is an optional element. Co causes the solidus temperature to increase and therefore provides an opportunity to raises the hardening temperature, which may be 15-30° C. higher than without Co. During austenitization it is therefore possible to dissolve larger fraction of carbides and thereby enhance the hardenability. Co also increases the $M_s$ temperature. However, large amount of Co may result in a decreased toughness and wear resistance. The maximum amount is 8% and, if added, an effective amount may be 2-6%, in particular 4 to 5%. However, for practical reasons, such as scrap handling, deliberate additions of Co is not made. The maximum impurity content may then be set to 1%, 0.5%, 0.3%, 0.2% or 0.1%.

Tungsten (≤1%)

In principle, molybdenum may be replaced by twice as much with tungsten because of their chemical similarities. However, tungsten is expensive and it also complicates the handling of scrap metal. The maximum amount is therefore limited to 1%, 0.7, 0.5, 0.3 or 0.15%. Preferably no deliberate additions are made.

Niobium (≤0.05%)

Niobium is similar to vanadium in that it forms carbonitrides of the type M(N,C) and may in principle be used to replace part of the vanadium but that requires the double amount of niobium as compared to vanadium. However, Nb results in a more angular shape of the M(N,C). The maximum amount is therefore 0.05%, 0.03 or 0.01%. Preferably no deliberate additions are made.

Ti, Zr and Ta

These elements are carbide formers and may be present in the alloy in the claimed ranges for altering the composition of the hard phases. However, normally none of these elements are added.

Boron (≤0.01%)

B may optionally be used in order to further increase the hardness of the steel. The amount is limited to 0.01%, preferably ≤0.005%. A preferred range for the optional addition of B is 0.001-0.004%.

Ca, Mg and REM (Rare Earth Metals)

These elements may be added to the steel in the claimed amounts for modifying the non-metallic inclusion and/or in order to further improve the machinability, hot workability and/or weldability.

Impurity Elements

P, S and O are the main non-metallic impurities, which have a negative effect on the mechanical properties of the steel. P may therefore be limited to 0.05, 0.04, 0.03 0.02 or 0.01%. S is limited to 0.003 may be limited to 0.0025, 0.0020, 0.0015, 0.0010, 0.0008 or 0.0005%. O may be limited to 0.0015, 0.0012, 0.0010, 0.0008, 0.0006 or 0.0005%.

Cu is not possible to extract from the steel. This drastically makes the scrap handling more difficult. For this reason, copper is not used. The impurity amount of Cu may be limited to 0.35, 0.30, 0.25, 0.20, 0.15 or 0.10%.

Hydrogen (≤0.0005%)

Hydrogen is known to have a deleterious effect on the properties of the steel and to cause problems during processing. In order to avoid problems related to hydrogen the molten steel is subjected to vacuum degassing. The upper limit is 0.0005% (5 ppm) and may be limited to 4, 3, 2.5, 2, 1.5 or 1 ppm.

Steel Production

The tool steel having the claimed chemical composition can be produced by conventional metallurgy including melting in an Electric Arc Furnace (EAF) and further ladle refining and vacuum treatment and casting into ingots. The steel ingots are then subjected to Electro Slag Remelting (ESR), preferably under protective atmosphere, in order to further improve the cleanliness and the microstructural homogeneity.

The steel is subjected to hardening before being used. Austenitizing may be performed at an austenitizing temperature ($T_A$) in the range of 850 to 950° C., preferably 880-920° C. A typical $T_A$ is 900° C. with a holding time of 30 minutes followed by slow cooling. The cooling rate is defined by the time the steel subjected to the temperature range 800° C. to 500° C., ($t_{800/500}$). The cooling time in this interval, $t_{800/500}$, should normally lie in the interval of 4000-20000 s in order to get the desired bainitic microstructure with minor amounts of retained austenite and martensite. This will normally result in hardness in the range of 38-42 HRC and/or a Brinell hardness of 360-400 $HBW_{10/3000}$. The Brinell hardness $HBW_{10/3000}$ is measured with a 10 mm diameter tungsten carbide ball and a load of 3000 kgf (29400N).

When the steel has a thickness of at least 100 mm then the maximum deviation from the mean Brinell hardness value in the thickness direction, measured in accordance with ASTM E10-01, is less than 10%, preferably less than 5%, wherein the distance of the center of the indentation from the edge of the specimen or edge of another indentation shall be at least two and a half times the diameter of the indentation and the maximum shall be no more than 4 times the diameter of the indentation.

The steels of the present invention have a uniform hardness because the composition has been optimized in order to reduce the meso-segregations, which may be formed in all type of ingots having a thickness of at least 100 mm. Meso-segregations are commonly referred to as A-type segregations, V-type segregations and Channel-type segregations and may form in all ingots having a thickness of at least 100 mm. The segregated regions have an elongated shape and a non-constant thickness of the order of 10 mm. The amount of meso-segregation increases with increasing size of the ingot and with increasing amount of heavy alloying elements like Mo (10.2 g/cm$^3$) and W (19.3 g/cm$^3$). The size of these segregations makes the homogenisation difficult and results in a banded structure in the forged and/or hot rolled product. The size of the bandings in the microstructure depends on the degree of reduction. A high degree of reduction leads to a smaller width of the bandings.

Example

In this example, a steel having the following composition was produced by EAF-melting, ladle refining and vacuum degassing (VD) followed by ESR remelting under protective atmosphere (in wt. %):

| | |
|---|---|
| C | 0.10 |
| Si | 0.27 |
| Mn | 2.42 |
| Cr | 3.00 |
| Ni | 0.99 |
| Mo | 0.29 |
| V | 0.03 |
| Al | 0.017 |
| P | 0.014 |
| S | 0.001 |

balance iron and impurities.

The steel was cast into ingots and subjected hot working in order to produce blocks having a cross section size of 1013×346 mm.

The steel was austenitized at 900° C. for 30 minutes and hardened by slow cooling, The time for cooling ($t_{800/500}$) was about 8360 seconds. This resulted in a mean hardness of 365 $HBW_{10/3000}$. The maximum deviation from the mean Brinell hardness value in the thickness direction was found to be less than 4% as measured in accordance with ASTM E10-01, wherein the minimum distance of the center of the indentation from the edge of the specimen or edge of another indentation was 3 times the diameter of the indentation. The mean impact energy in the LT direction was measured using a standard Charpy-V test in accordance with SS-EN ISO148-1/ASTM E23. The mean value of 6 samples was 32 J. The amount of retained austenite was estimated to be about 7 vol. %.

The cleanliness of steel was examined with respect to micro-slag according to ASTM E45-97, Method A. The result is shown in Table 1.

TABLE 1

Result of cleanliness measurement.

| A | A | B | B | C | C | D | D |
|---|---|---|---|---|---|---|---|
| T | H | T | H | T | H | T | H |
| 0 | 0 | 1.0 | 0.5 | 0 | 0 | 1.0 | 0.5 |

This example demonstrate that a large steel block having high and uniform hardness, a high toughness and a high purity could be produced by re-melting in an ESR unit under protective atmosphere.

INDUSTRIAL APPLICABILITY

The steel of the present invention is particular useful in large tool holders requiring a high toughness and a uniform hardness.

The invention claimed is:

1. A steel for a tool holder, consisting of, in weight % (wt. %):

| | |
|---|---|
| C | 0.07-0.13 |
| Si | 0.10-0.40 |
| Mn | 2.1-2.8 |
| Cr | 2.6-3.6 |
| Ni | 0.5-2.0 |
| Mo | 0.1-0.7 |
| Al | 0.001-0.06 |
| S | ≤0.003 |

optionally

| | |
|---|---|
| N | 0.006-0.06 |
| V | 0.01-0.2 |
| Co | ≤8 |
| W | ≤1 |
| Nb | ≤0.03 |
| Ti | ≤0.03 |
| Zr | ≤0.03 |
| Ta | ≤0.03 |
| B | ≤0.01 |
| Ca | ≤0.01 |
| Mg | ≤0.01 |
| REM | ≤0.2, and |

balance Fe apart from impurities, wherein the steel has a bainitic microstructure comprising up to 20 volume % retained austenite and up to 20 volume % martensite, and wherein the steel has a cleanliness fulfilling the following maximum requirements with respect to micro-slag according to ASTM E45-97, Method A:

| A | A | B | B | C | C | D | D |
|---|---|---|---|---|---|---|---|
| T | H | T | H | T | H | T | H |
| 1.0 | 0 | 1.5 | 1.0 | 0 | 0 | 1.5 | 1.0. |

2. The steel for a tool holder according to claim 1, fulfilling the following requirements:

| | |
|---|---|
| C | 0.08-0.12 |
| Ni | 0.7-1.2 |
| Mo | 0.15-0.55 |
| Al | 0.001-0.035 |

optionally

| | |
|---|---|
| N | 0.006-0.03 |
| V | 0.01-0.08 |
| Co | ≤1 |
| W | ≤0.1 |
| B | ≤0.001 |
| Ca | ≤0.001 |

-continued

| | |
|---|---|
| Mg | ≤0.01 |
| REM | ≤0.1, and |

retained austenite 2-20 vol. %.

3. The steel for a tool holder according to claim 1, fulfilling at least one of the following requirements:

| | |
|---|---|
| C | 0.08-0.11 |
| Si | 0.15-0.35 |
| Mn | 2.2-2.8 |
| Cr | 2.5-3.5 |
| Ni | 0.85-1.15 |
| Mo | 0.20-0.45 |

optionally

| | |
|---|---|
| V | 0.01-0.06 |
| Co | ≤0.3 |
| Nb | ≤0.01 |
| Ti | ≤0.01 |
| Zr | ≤0.01 |
| Ta | ≤0.01 |
| REM | ≤0.05,and |

retained austenite 5-10 vol. %.

4. The steel for a tool holder according to claim 1, fulfilling the following requirements:

| | |
|---|---|
| C | 0.08-0.11 |
| Mn | 2.2-2.8 |

-continued

| | |
|---|---|
| Cr | 2.5-3.5 |
| Ni | 0.7-1.2, and |
| Mo | 0.15-0.45. |

5. The steel for a tool holder according to claim 1, wherein the amount of retained austenite is 4-15 volume % and/or the amount of martensite is 2-16 volume %.

6. The steel for a tool holder according to claim 1, wherein the amount of retained austenite is 4-12 volume % and/or the amount of martensite is 4-12 volume %.

7. The steel for a tool holder according to claim 1, wherein the amount of retained austenite is 5-9 volume % and/or the amount of martensite is 5-10 volume %.

8. The steel for a tool holder according to claim 1, wherein the steel has a hardness of 38-42 HRC and/or 360-400 $HBW_{10/3000}$.

9. The steel for a tool holder according to claim 1, wherein the steel has a mean hardness in the range of 360-400 $HBW_{10/3000}$, wherein the steel has a thickness of at least 100 mm and the maximum deviation from the mean Brinell hardness value in the thickness direction measured in accordance with ASTM E10-01 is less than 10%, and wherein the minimum distance of the centre of the indentation from the edge of the specimen or edge of another indentation shall be at least two and a half times the diameter of the indentation and the maximum distance shall be no more than 4 times the diameter of the indentation.

10. The steel for a tool holder according to claim 9, wherein the maximum deviation from the mean Brinell hardness value in the thickness direction measured in accordance with ASTM E10-01 is less than 5%.

* * * * *